US005390624A

United States Patent [19]

Barnes

[11] Patent Number: 5,390,624

[45] Date of Patent: Feb. 21, 1995

[54] BOAT WITH PAD BOTTOM HULL

[75] Inventor: Russell J. Barnes, Christiana, Tenn.

[73] Assignee: Brunswick Corporation, Lake Forest, Ill.

[21] Appl. No.: 39,609

[22] Filed: Mar. 24, 1993

[51] Int. Cl.[6] ..... B63H 5/16

[52] U.S. Cl. ..... 114/288; 440/66

[58] Field of Search ..... 114/56, 57, 271, 274, 114/288, 291; 440/66, 68

[56] References Cited

U.S. PATENT DOCUMENTS

| | | | |
|---|---|---|---|
| 3,363,598 | 1/1968 | Mortrude | 114/56 |
| 3,776,168 | 12/1973 | Weeks | 114/56 |
| 4,348,972 | 9/1982 | Parsons | 114/56 |
| 4,409,922 | 10/1983 | Mambretti | 114/56 |
| 4,584,959 | 4/1986 | Allison | 114/288 |
| 4,915,668 | 4/1990 | Hardy | 114/288 |
| 5,046,439 | 9/1991 | Goodson et al. | 114/56 |

*Primary Examiner*—Stephen P. Avila
*Attorney, Agent, or Firm*—Lewis L. Lloyd

[57] ABSTRACT

A planing boat having a stern and a bow includes a hull having a generally flat central bottom surface forming a portion of a pad with the surface tapering from a specified width at the stern towards the bow. Reverse wedge surfaces blended with the central bottom surface at the stern and deadrise surfaces blended with the central bottom surface and intersecting with the reverse wedge surfaces continue forward towards the bow. The rear portion of the flat bottom surface is tipped upwardly towards the stern.

2 Claims, 8 Drawing Sheets

26
64
64
52a
70g
52b
54
58g 26
64
64
70f
52a
38
52b
58f
44f 26
64
64
70e
52a
38
52b
44e
58e 26
64
64
70d
52a
38
52b
44d
58d 64
56a,56
56b,56
26
64
66
70c
38
46a,62c
44c
46b,62c
52a,60a
52b,60a
58c 64
26
64
56a,56
56b,56
66
70b
38
46a,62b
44b
46b,62b
52a,60a
52b,60a
58b 64
26
64
68
66
38
46a,62a
44a
46b,62a
58a 164
166
146a,62a
168
138
144a
158a
126
164
146b, 162

164
170b
146,162b
156a,156
138
152a,160a
144b
156b, 156
152b,160a
158b
126
164
166
146b,162b 164
170b
146a,162c
156a, 156
138
152a,160a
144c
156b,156
152b,160a
158c
126
164
166
146b,162c 126
164
166
146a, 162c
156a,156
152a,160a
138
144d
158d
156b,156
152b,160a
146b,162c
164
170d 126
164
146a, 162c
156a,156
152a,160a
138
144e
158e
146b,162c
156b,156
152b,160a
164
166
170d 164
152a
138
158f
152b
170f
164
126

164
152a
170g
158g
138
152b
164
126

BOAT WITH PAD BOTTOM HULL

BACKGROUND OF THE INVENTION

The field of the invention relates to a boat and more particularly concerns a boat with a hull including a pad bottom.

Observation and experience has shown that the traditional boats with pad bottom hulls are typically very light and travel at high speeds and many require a great deal of skill to pilot. These traditional pad bottom hulls are very inefficient when the boat is loaded for tournament fishing and a great amount of speed is lost.

An example of a prior pad is disclosed in U.S. Pat. No. 4,584,959. The pad is generally rectangular and it gradually changes in shape as shown in FIG. 13. The rectangular pad includes two horizontal strakes along its edges.

SUMMARY OF THE INVENTION

In the present invention the intent is to provide a pad surface having a flat wide portion for maximum boat lift and include in a pad profile hydrodynamic features to maximize the stability of the boat; to retain a soft ride of the boat; and to reduce the normal drag resulting from the prior boats having rectangular pad configurations.

In one feature of the preferred embodiment the pad surface has a width at the stern which is appropriate for the size and weight of the boat. The pad surface then transitions narrower as it progresses forward to meet the bow of the boat. This results in reduced drag and retains a soft ride for the boat.

In other features of the preferred embodiment additional surfaces are blended to both edges of the pad surface to form a pad. One other feature is a negative V surface which is blended to both edges of the pad surface adjacent the stern of the boat. These negative V surfaces form reverse wedge surfaces. Another feature is a positive deadrise surface which is blended to both edges of the pad surface forward of the reverse wedge surfaces and which extends towards the bow of the boat. The reverse wedge surfaces and the deadrise surfaces on both sides of the pad surface meet at an intersection between the negative surface of the reverse wedge surface and the positive surface of the deadrise surface. These reverse wedge surfaces and positive deadrise surfaces provide multiple benefits in the operation of the boat. First, this shaping of the outer edge of the pad improves the stability of the boat. This stability is believed to be improved by the forces created by the resultant direction of the water flow at the intersection of these surfaces since the two directions of water flow meet at this intersection. This water flow edge loading is believed to make the boat more stable; as if it had outriggers. Second, the intersection of the two directions of water flow is believed to result in the retention of more of the kinetic energy as the force of the water flow is no longer being lost in spray thrown out along the side of the boat.

In still another feature of the preferred embodiment the pad surface at the stern of the boat is altered relative to the boat bottom. The rear of the pad surface at the stern is tipped upwardly. By tipping the rear of the pad surface upward the boat increases its trim angle without requiring the propeller to generate lift. This particularly improves the hull efficiency and the runing attitude of the boat.

An alternative embodiment of a different boat which includes the features of the preferred embodiment is also disclosed.

All the pad features of the preferred and alternative embodiment maximize the flow of water past the boat in a rearward direction while retaining the ability of the boat to encounter changing wave patterns without a pounding of the boat.

DESCRIPTION OF THE PREFERRED EMBODIMENT

Figure 1:
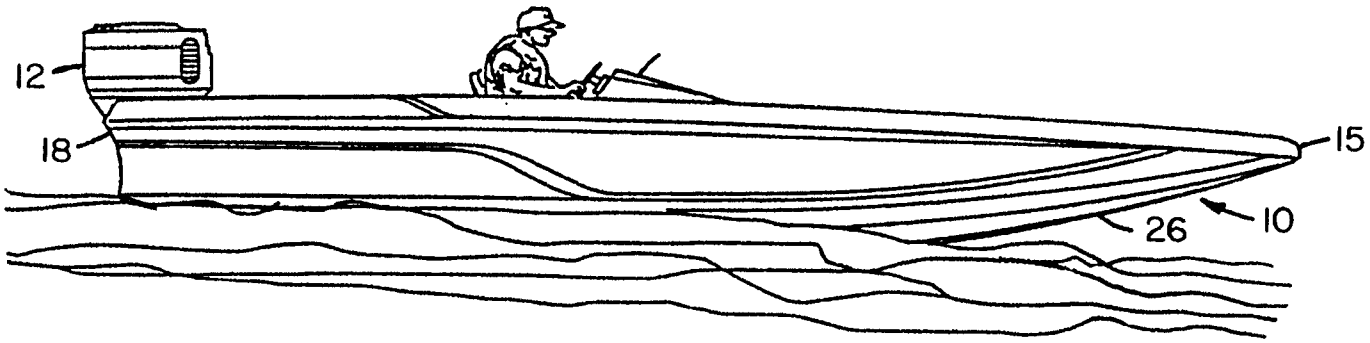
FIG. 1 is a side elevation view of a boat.
Figure 2:
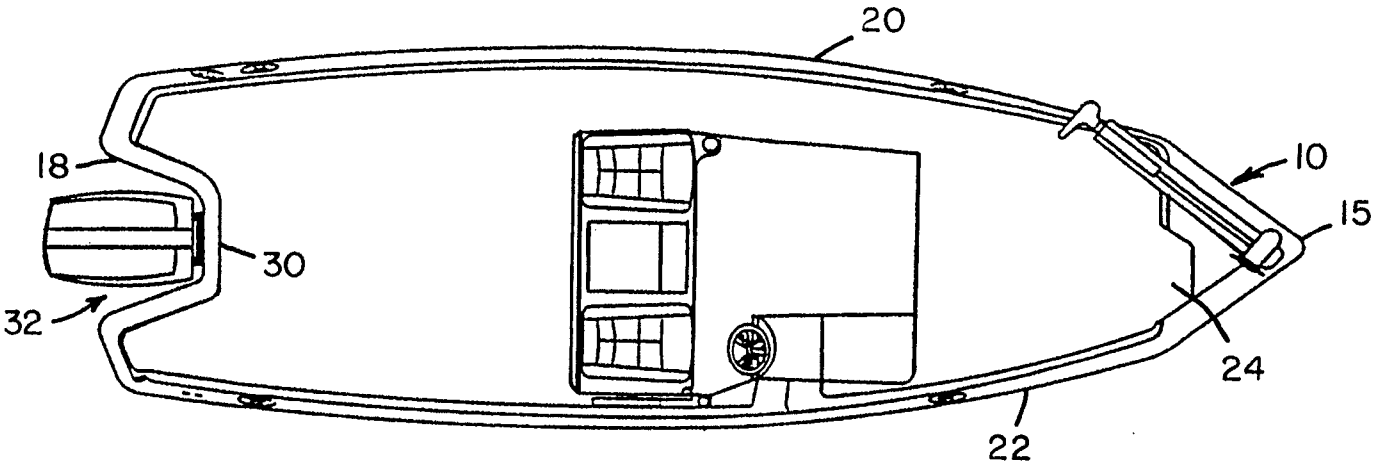
FIG. 2 is a top plan view of the boat of FIG. 1.

A planing boat 10 is shown in FIGS. 1 through 4. The boat 10 includes an outboard motor 12 and a drivers console 14. The boat has a bow 16, a stern 18, a port side 20, a starboard side 22 and a top deck 24. The boat 10 which is preferably formed of reinforced fiberglass includes a planing hull 26 having a bottom planing surface and transom 30. An well or notch 32 is formed at the transom 30 to mount the outboard motor 12. The bottom planing surface includes a bottom pad planing surface or pad 34

Figure 3:
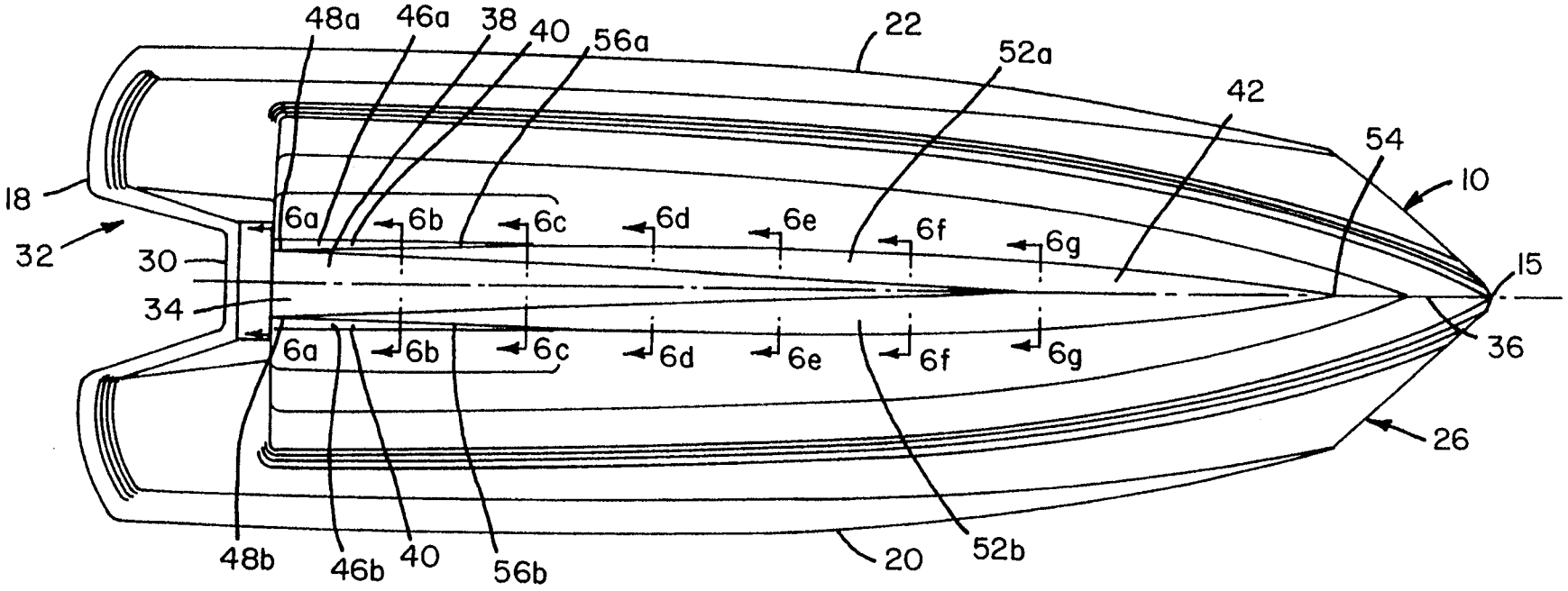
FIG. 3 is a bottom plan view of the hull for the boat of FIG. 1.
Figure 4:
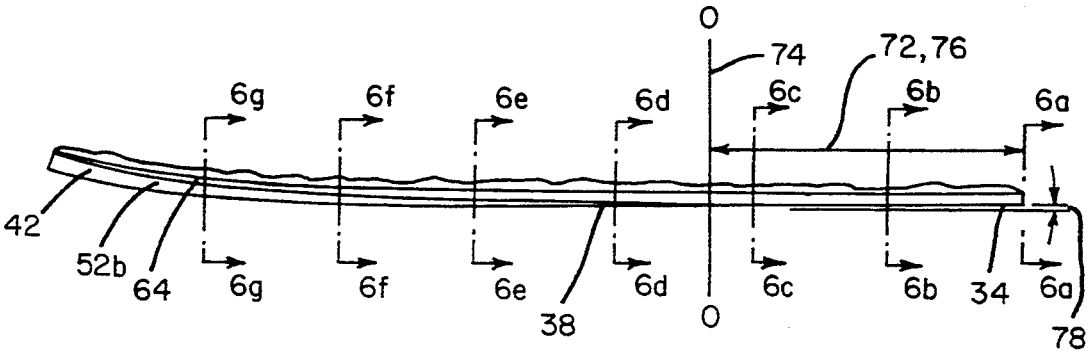
FIG. 4 is a partial broken away view of a portion of the hull of the boat shown in FIG. 1 particularly showing the bottom pad.
Figure 5:
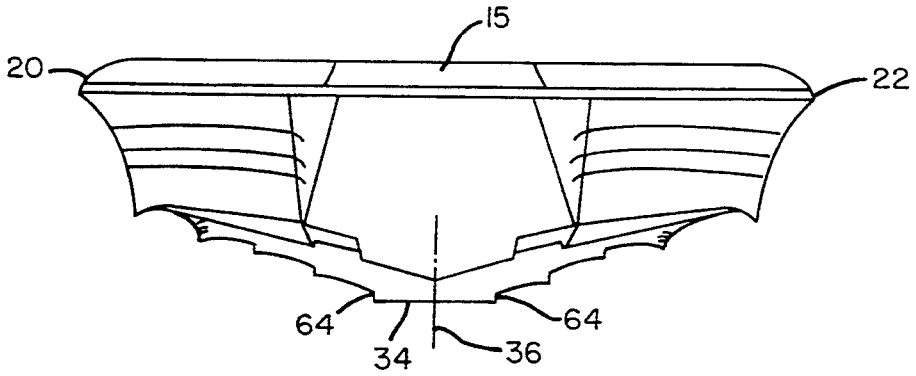
FIG. 5 is an end elevation view showing the transom of the boat of FIG. 1.

The pad 34 is the primary feature of the preferred embodiment. The pad 34 is generally centered on the boat center line 36 at the lower portion of the bottom planing surface 28. The pad 34 is best shown in FIGS. 3, 4 and 5. Referring to FIG. 3, the pad 34 is symmetrical to the bottom planing surface 28 and contains a first pad surface 38, a second pad surface 40 and a third pad surface 42.

The pad 34 extends from the transom 30 towards the bow 16 as shown in FIGS. 3 and 4. The pad 34 at the stern 18 is selected to have a width proportional for the size and weight of the boat. For a Procraft Model SP 180 manufactured by Brunswick Marine the pad width 44*a* of the first pad surface 38 of the pad 34 at the stern 18 is about 9 inches. The pad surface 38 is transitioned to narrow as it traverses towards the bow 16.

Figures 6A, 6B, 6C, 6D, 6E, 6F, 6G:
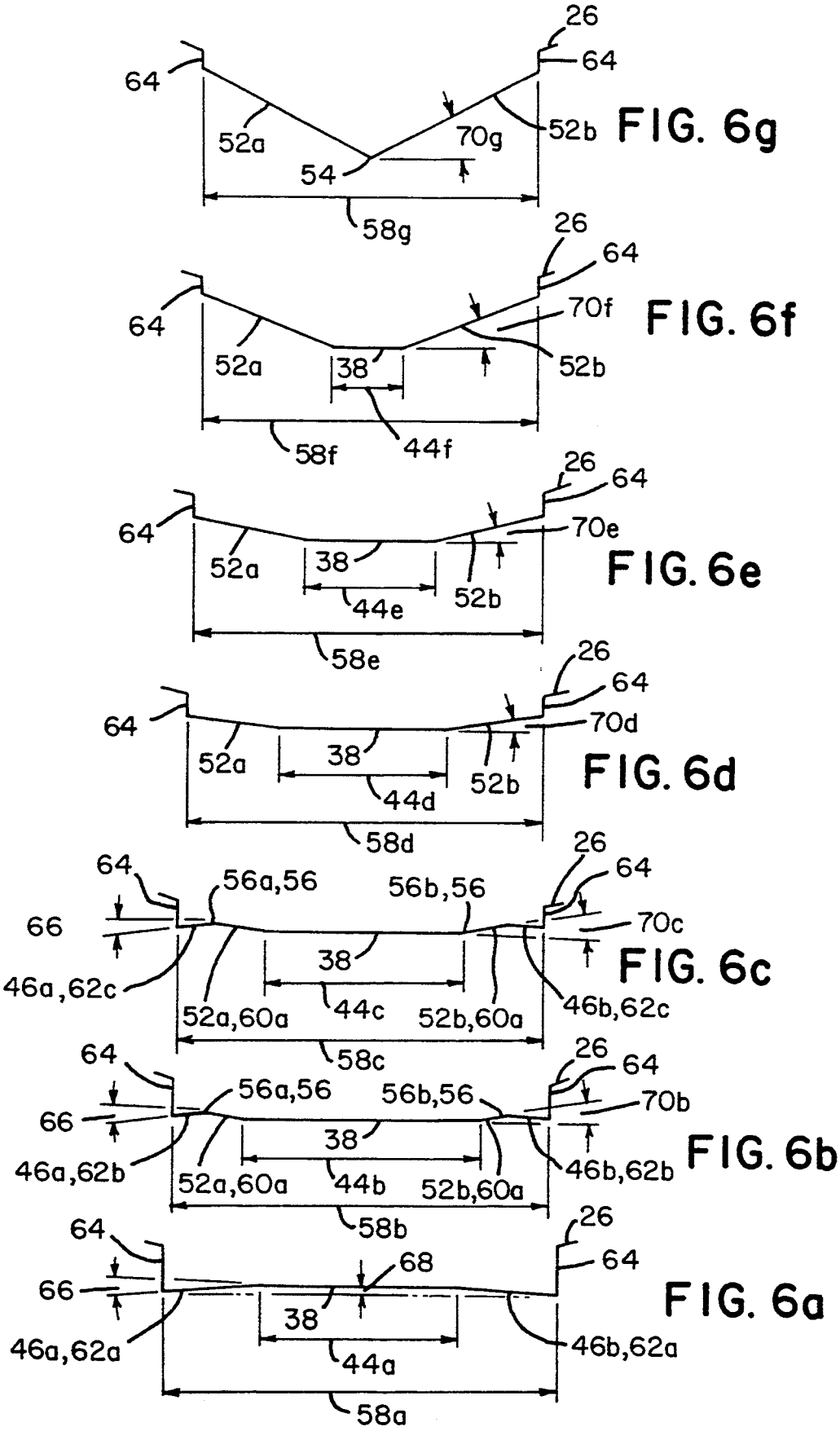
FIG. 6*a* through 6*g* are a series of partial profiles along the boat of FIG. 1 particularly showing a portion of the hull and the bottom pad.
Figure 7:
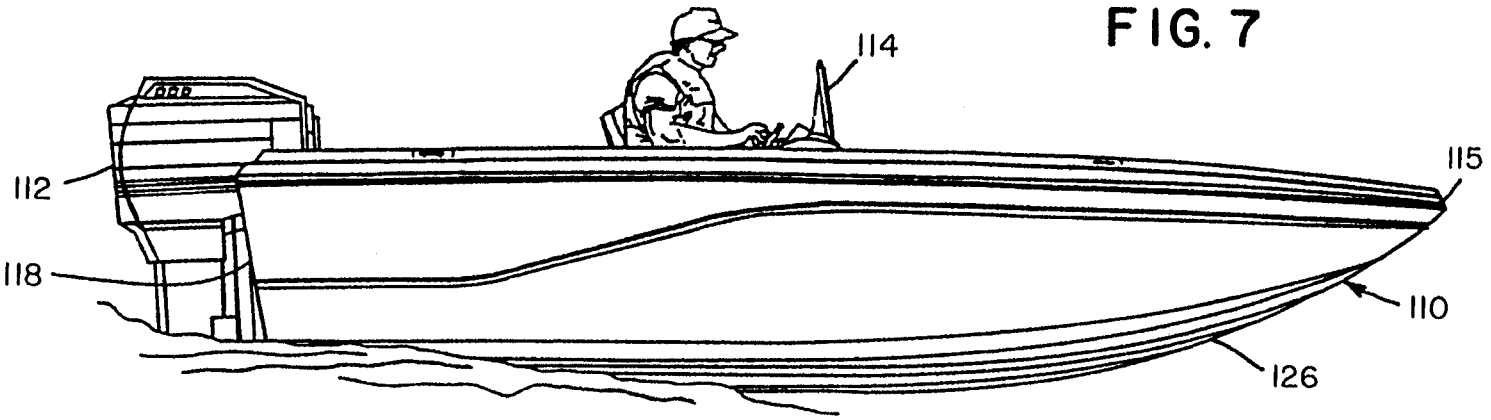
FIG. 7 is a side elevation view of an alternate embodiment of a boat.
Figure 8:
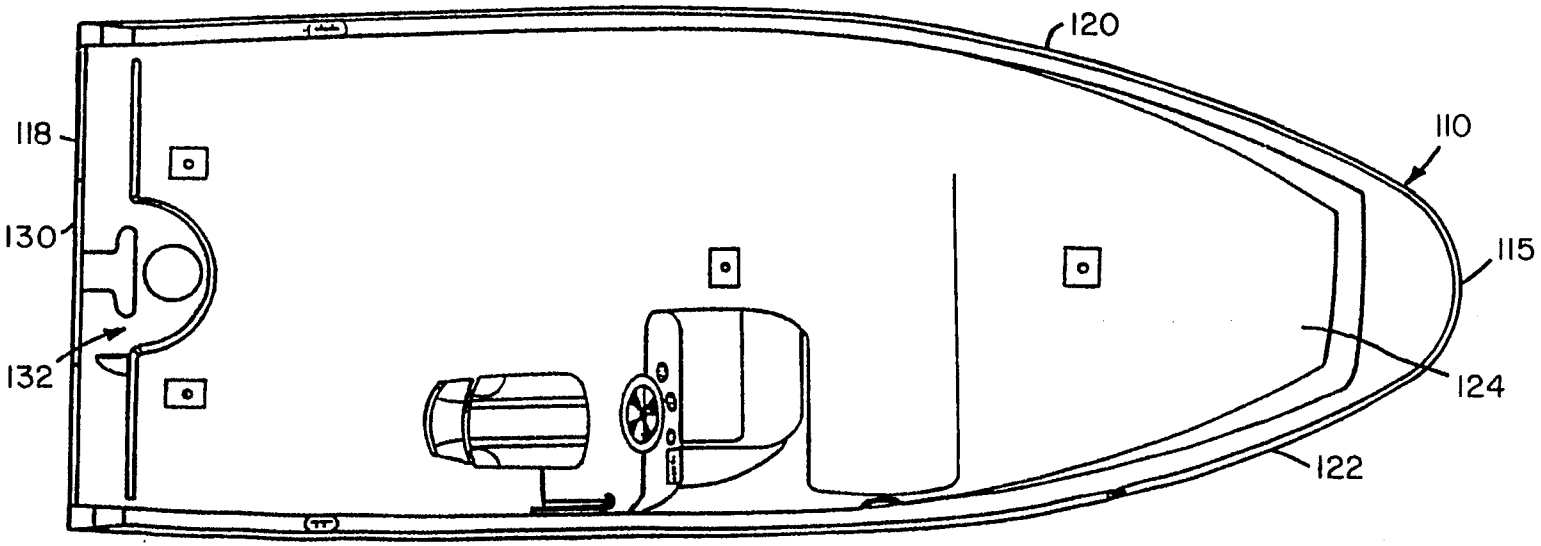
FIG. 8 is a top plan view of the boat of FIG. 7.

The shape of the pad 34 at the stern is best shown in FIG. 6*a*. FIG. 6*a* is the pad profile at the beginning of the pad 34 at the stern 18 and FIG. 6*g* is the pad profile at about the end of the pad 34 in the direction of the bow 16. The width 44*g* of the first pad surface 38 of the pad profile in FIG. 6*g* is about 0 inches. In other words, the pad profile at FIG. 6g is at about the end of the first pad surface 38.

FIGS. 6*b* through 6*f* are intermediate pad profiles at 18 inch increments along the pad 34. The width 44*b* in FIG. 6*b* is about $7\frac{1}{4}$ inches. The width 44*c* in FIG. 6*c* is about 6 inches. The width 44*d* in FIG. 6*d* is about $4\frac{3}{8}$ inches. The width 44*e* in FIG. 6*e* is about 2 inches. The width 44*f* in FIG. 6*f* is about $\frac{3}{8}$ inch.

Another feature of the preferred embodiment are reverse wedges 46*a* and 46*b*. The reverse wedges 46*a* and 46*b* are blended to the edges 48*a* and 48*b* of the first pad surface 38 of the pad 34 for a portion of the pad 34 between the profile at FIG. 6*a* and the profile at FIG. 6*b*. The reverse wedges 46*a* and 46*b* form the second pad surface 40. In FIG. 6*a* the reverse wedges 46*a* and 46*b* each have a width 50 of about 2 inches.

The pad 34 also includes deadrise surfaces 52*a* and 52*b* which are blended with the edges 48*c* and 48*d* of the first pad surface 38 of the pad 34 for a portion of the pad 34 between the profile shown in FIG. 6*c* and the profile shown in FIG. 6*g* and extending to the intersection of the two dead rise surfaces 52*a* and 52*b* at about a point 54 on the centerline 36. The deadrise surfaces 52*a* and 52*b* form the third pad surface 42.

The reverse wedge 46*a* blends and intersects at a line or plane 56*a* with the deadrise surface 52*a*. The reverse wedge 46*b* blends and intersects at a line or plane 56*b* with the deadrise surface 52*b*. These intersections 56*a* and 56*b* direct the flow of water past the hull 26 towards the stern 18 of the boat 10.

FIG. 6*b* shows a point 56 at the intersection 56*a* of the reverse wedge 46*a* and the deadrise surface 52*a*. FIG. 6*b* also shows a point 56 at the intersection 56*b* of the reverse wedge 46*b* and the deadrise surface 52*a*. FIG. 6*c* also shows a point 56 at the intersection 56*a* of the reverse wedge 46*a* and the deadrise surface 52*a*. FIG. 6*c* also shows a point 56 at the intersection 56*b* of the reverse wedge 46*b* and the deadrise surface 52*a*.

FIG. 6*d* through 6*g* no longer show the reverse wedges 46*a* and 46*b* since they have ended prior to these profiles. FIGS. 6*d* through 6*g* show a gradual change in the deadrise surfaces 52*a* and 52*b* as they transition towards the point 54 at the bow 16.

The total width 58*a* of the pad 34 at the profile of FIG. 6*a* is about 13 inches. The total width 58*b* of the pad 34 at the profile of FIG. 6*b* is about $12\frac{3}{4}$ inches. This includes a portion of about $1\frac{1}{2}$ in wide 60*a* for each of the deadrise surfaces 52*a* and 52*b* and a portion of about $1\frac{1}{4}$ inch wide 62*a* for each of the reverse wedges 46*a* and 46*b*.

The total width 58*c* of the pad 34 at the profile of FIG. 6*c* is about $12\frac{1}{2}$ inches. This includes a portion of about $2\frac{1}{2}$ in wide 60*b* for each of the deadrise surfaces 52*a* and 52*b* and a portion of about $\frac{3}{4}$ inch wide 62*b* for each of the reverse wedges 46*a* and 46*b*.

The total width 58*d* of the pad 34 at the profile of FIG. 6*d* is about $12\frac{3}{8}$ inches. The total width 58*e* of the pad 34 at the profile of FIG. 6*e* is about $12\frac{1}{4}$ inches. The total width 58*f* of the pad 34 at the profile of FIG. 6f is about $12\frac{1}{8}$ inches. The total width 58*g* of the pad 34 at the profile of FIG. 6*g* is about 12 inches.

The entire pad 34 is stepped down or away from the remaining portion of the planing hull 26 with a step 64 of about 1 to $1\frac{1}{2}$ inches as shown in FIGS. 6*a* through 6*g*.

The acute angle 66*a* from the horizontal between the first planing surface 38 and each of the reverse wedges 46*a* and 46*b* in FIG. 6*a* is about minus 1 degree. This results in a trough or tunnel 68 of about $\frac{1}{8}$ inch deep within the pad 34. The combination of the flat surface of the first planing surface 38*b* and the reverse or negative 1 degree surface of the reverse wedges 46*a* and 46*b* permits the boat 10 to carry the weight of additional people while at the same time reducing the friction of these surfaces as the weight of the boat is increased.

The acute angle 66*b* from the horizontal of each of the reverse wedges 46*a* and 46*b* in FIG. 6*b* is also about minus 1 degree and the acute angle 70*b* from the horizontal of each of the deadrise surfaces 52*a* and 52*b* is about 8 degrees. The acute angle 66*c* from the horizontal of each of the reverse wedges 46*a* and 46*b* in FIG. 6*c* is also about minus 1 degree and the acute angle 70*c* from the horizontal of each of the deadrise surfaces 52*a* and 52*b* is about $9\frac{1}{2}$ degree. The acute angle 70*d* from the horizontal of each of the deadrise surfaces 52*a* and 52*b* in FIG. 6*d* is about 10 degrees. The acute angle 70*e* from the horizontal of each of the deadrise surfaces 52*a* and 52*b* in FIG. 6*e* is about 15 degrees. The acute angle 70*f* from the horizontal of each of the deadrise surfaces 52*b* in FIG. 6*f* is about 22 degrees. The acute angle 70*g* from the horizontal of each of the deadrise surfaces 52*a* and 52*b* in FIG. 6*g* is about 28 degrees.

It can therefore be seen that the acute angle from the horizontal of the deadrise surfaces 52*a* and 52*b* increases from the stern 18 towards the bow 16. This increasing angle helps lower the drag of the boat 10 allowing faster planing of the boat 10.

An additional feature of the preferred embodiment is the altering of the pad 34 relative to the boat 10. The rear portion 72 of the pad 35 is tipped upward towards the stern 18 of the boat 10. By tipping the the rear of the pad 34 upward the boat 10 increases its trim angle without requiring the propeller to generate lift. The propeller trim angle can be adjusted to utilize the maximum thrust in moving the boat forward and to eliminate the loss of thrust from the propeller generating lift to the boat 10. The tipping line 74 through the pad 34 is identified in the Figures to be at plane 0—0. At the tipping line 74 the rear of the pad 34 for a distance 76 of about 42 inches is tipped upward at an angle 78 of about $\frac{3}{4}$ degrees. The preferred tipping angle is in the range of $\frac{1}{2}$ to 3 degrees for a length of about 36 inches to 60 inches depending on the weight and the length of the boat 10. The tipping of the rear portion 72 of the pad 34 improves the efficiency of the planing hull 26 and improves the running attitude of the boat 10.

An alternative embodiment of the invention is shown in FIGS. 7 through 12. The feature of the pad and the alternative features of the reverse wedges and the tipped rear portion of the pad are similar to that described for the preferred embodiment described above and shown for boat 10, but are modified for the alternative embodiment shown and described for boat 110.

In the alternative embodiment, a planing boat 110 is shown in FIGS. 7 through 10. The boat 110 includes an outboard motor 112 and a drivers console 114. The boat has a bow 115, a stern 118, a port side 120, a starboard side 122 and a top deck 124. The boat 110 which is preferably formed of reinforced fiberglass includes a planing hull 126 having a bottom planing surface and transom 130. An well or notch 132 is formed at the transom 130 to mount the outboard motor 112. The bottom planing surface includes a bottom pad planing surface or pad 134

Figure 9:
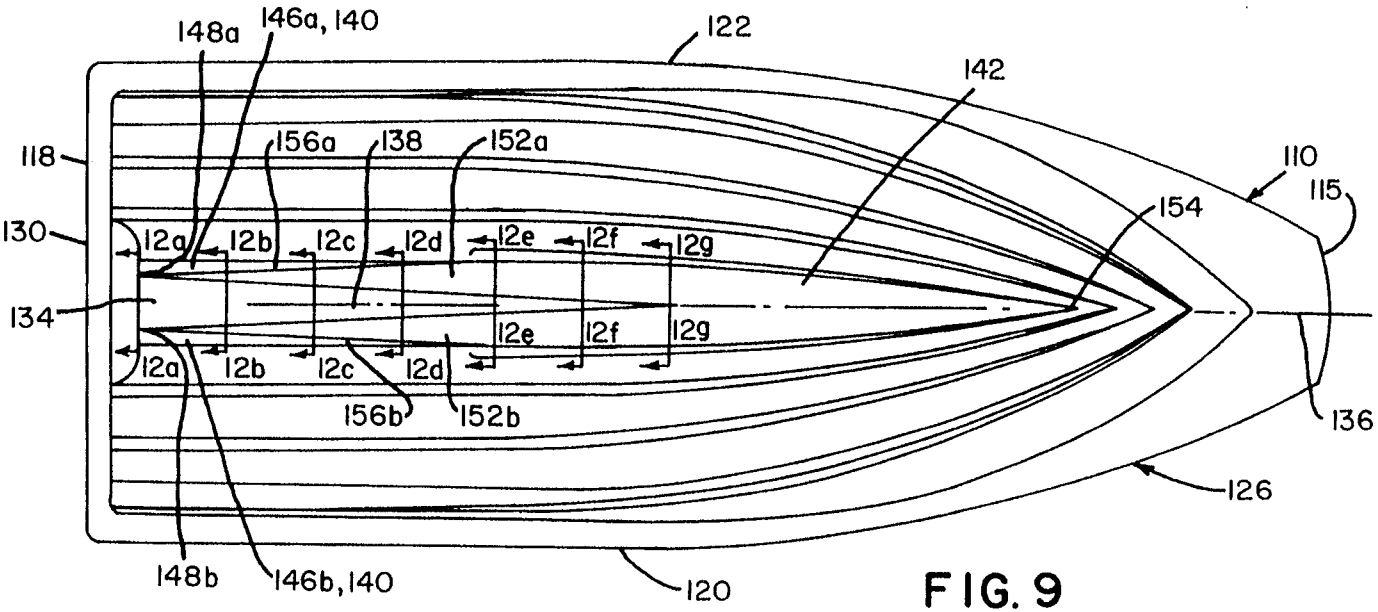
FIG. 9 is a bottom plan view of the hull for the boat of FIG. 7.
Figure 11:
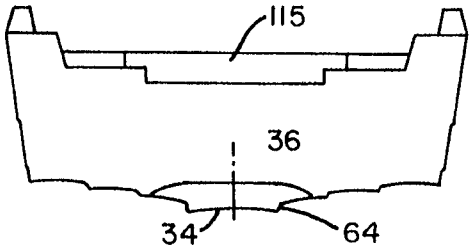
FIG. 11 is an end elevation view showing the transom of the boat of FIG. 7.
Figure 10:
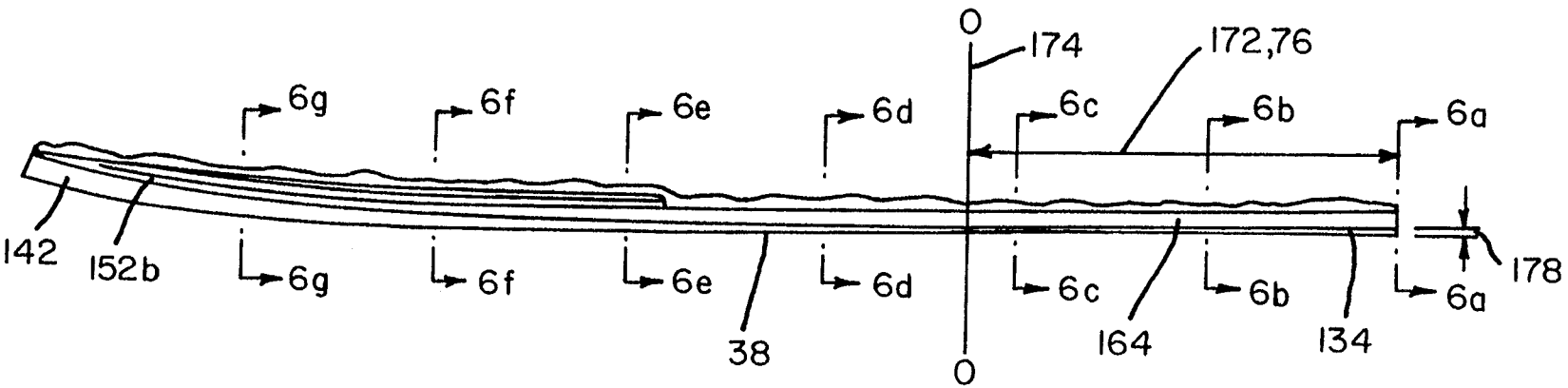
FIG. 10 is a partial broken away view of a portion of the hull of the boat shown in FIG. 7 particularly showing the bottom pad.

The pad 134 is the primary feature of the alternative embodiment. The pad 134 is generally centered on the boat center line 136 at the lower portion of the bottom planing surface 128. The pad 134 is best shown in FIGS. 9, 10 and 11. Referring to FIG. 9, the pad 134 is a symmetrical to the bottom planing surface 128 and contains a first pad surface 138, a second pad surface 140 and a third pad surface 142.

The pad 134 extends from the transom 130 towards the bow 116 as shown in FIGS. 9 and 10. The pad 134 at the stern 118 is selected to have a width 144 proportional for the size and weight of the boat. For a Procraft Model PF 1700 manufactured by Brunswick Marine the pad width 144*a* of the pad 134 at the stern 118 is about 8 inches. The pad 34 is transitioned to narrow as it traverses towards the bow 116.

Figures 12A, 12B, 12C, 12D, 12E, 12F, 12G:
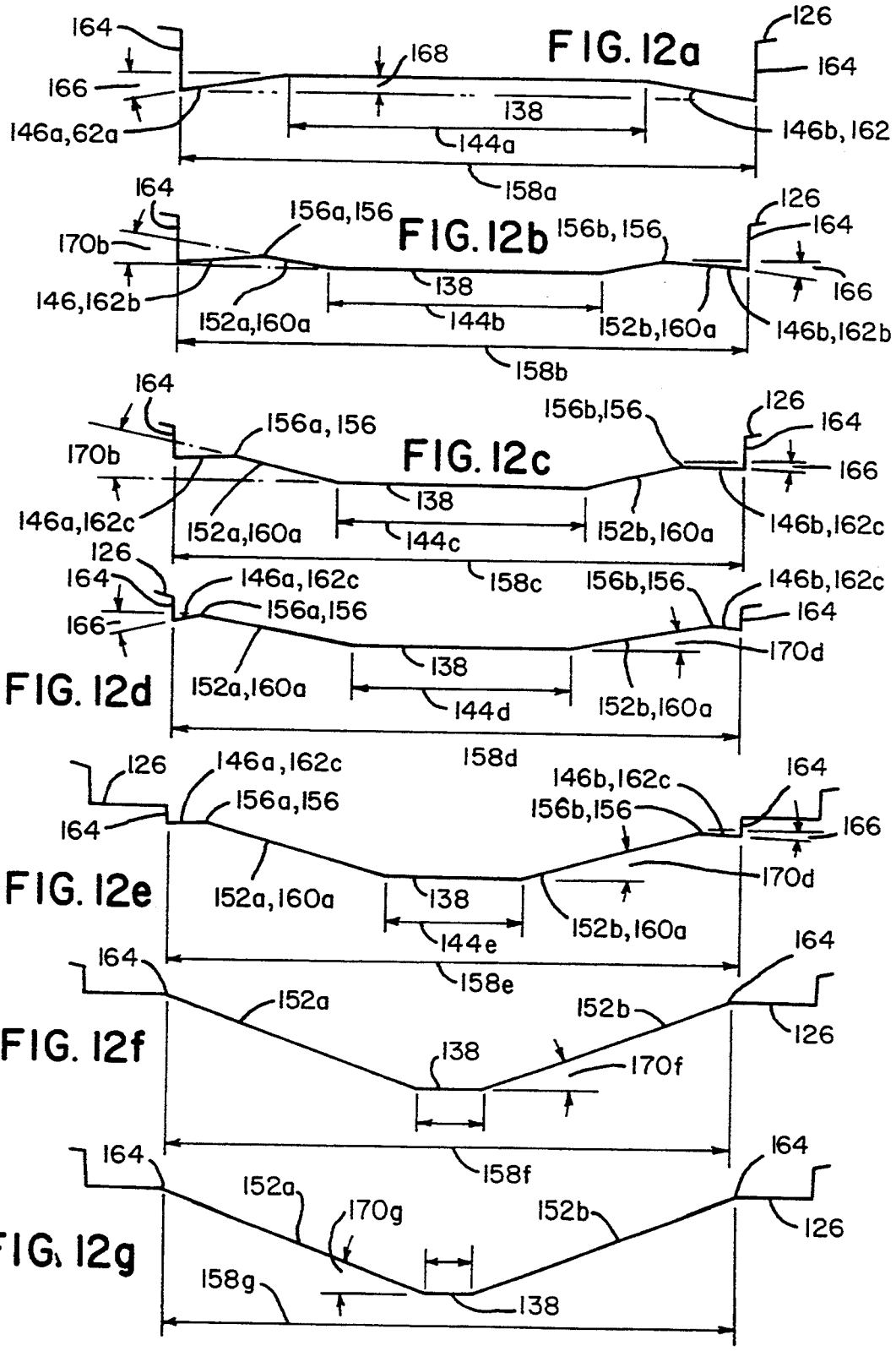
FIG. 12*a* through 12*g* are a series of partial profiles along the boat of FIG. 7 particularly showing a portion of the hull and the bottom pad.

The shape of the pad 134 at the stern is best shown in FIG. 12*a*. FIG. 12*a* is the pad profile at the beginning of the pad 134 at the stern 118 and FIG. 12*g* is the pad profile at about the end of the pad 134 in the direction of the bow 116. The width 144*g* of the first pad surface 138 of the pad profile in FIG. 12*g* is about 1 inches. In other words, the pad profile at FIG. 12*g* is very close to the end of the first pad surface 138.

FIGS. 12*b* through 12*f* are intermediate pad profiles at 18 inch increments along the pad 134. The width 144*b* in FIG. 12*b* is about 6 inches. The width 144*c* in FIG. 12*c* is about 5 inches. The width 144*d* in FIG. 12*d* is about 4 inches. The width 144*e* in FIG. 12*e* is about 3 inches. The width in FIG. 12*f* is about $1\frac{1}{2}$ inches.

Another feature of the alternative embodiment are reverse wedges 146*a* and 146*b*. The reverse wedges 146*a* and 146*b* are blended with the edges 148*a* and 148*b* of the first pad surface 138 of the pad 134 for a portion of the pad 134 between the profile at FIG. 12*a* and the profile at FIG. 12*e*. The reverse wedges 146*a* and 146*b* form the second pad surface 140. In FIG. 12*a* the reverse wedges 146*a* and 146*b* each have a width 150 of about $2\frac{1}{2}$ inches.

The pad 134 also includes deadrise surfaces 152*a* and 152*b* which are blended with the edges 148*c* and 148*d* of the first pad surface 138 of the pad 134 for a portion of the pad 134 from the profile shown in FIG. 12*a* and extending to the intersection of the two deadrise surfaces 152*a* and 152*b* at about a point 154 on the centerline 136. The deadrise surfaces 152*a* and 152*b* form the third pad surface 142.

The reverse wedge 146*a* blends and intersects at a line or plane 156*a* with the deadrise surface 152*a*. The reverse wedge 146*b* blends and intersects at a line or plane 156*b* with the deadrise surface 152*b*. These intersections 156*a* and 156*b* direct the flow of water past the hull 156 towards the stern 118 of the boat 110.

FIGS. 12*b* through 12e show a point 156 at the intersection 156*a* of the reverse wedge 146*a* and the deadrise surface 152*a*. FIG. 12*b* through 12*e* also show a point 156 at the intersection 156*b* of the reverse wedge 146*b* and the deadrise surface 152*a*. FIG. 12*f* and 12*g* no longer show the reverse wedges 146*a* and 146*b* since they have ended prior to these profiles. FIGS. 12*a* through 12*g* show a gradual change in the deadrise surfaces 152*a* and 152*b* as they transition towards the point 154 at the bow 116.

The total width 158*a* of the pad 134 at the profile of FIG. 12*a* is about 13 inches. The total width 158*b* of the pad 134 at the profile of FIG. 12*b* is about 13 inches. This includes a portion of about $2\frac{1}{4}$ in wide 160*a* for each of the dead rise surfaces 152*a* and 152*b* and a portion of about $1\frac{1}{4}$ inch wide 162*a* for each of the reverse wedges 146*a* and 146*b*.

The total width 158*c* of the pad 134 at the profile of FIG. 12*c* is about 13 inches. This includes a portion of about $2\frac{1}{2}$ in wide 160*b* for each of the deadrise surfaces 152*a* and 152*b* and a portion of about $1\frac{1}{2}$ inch wide 162*b* for each of the reverse wedges 146*a* and 146*b*.

The total width 158*d* of the pad 134 at the profile of FIG. 12*d* is about 13 inches. This includes a portion of about $3\frac{1}{2}$ inches wide 160*b* for each of the deadrise surfaces 152*a* and 152*b* and a portion of about 1 inch wide for each of the reverse wedges 146*a* and 146*b*. The total width 158*e* of the pad 134 at the profile of FIG. 12*e* is about 13 inches. This includes a portion of about 4 inches wide 160*b* for each of the deadrise surfaces 152*a* and 152*b* and a portion 1 inch wide for each of the reverse wedges 146*a* and 146*b*. The total width 158*f* of the pad 134 at the profile of FIG. 12*f* is about 13 inches. The total width 158*g* of the pad 134 at the profile of FIG. 12*g* is about 13 inches.

The entire pad 134 is stepped down or away from the remaining portion of the planing hull 126 with a step 164 between about 0 and about $1\frac{1}{2}$ inches as shown in the profiles of FIGS. 12*a* through 12*g*.

The acute angle 166*a* from the horizontal between the first planing surface 138 and each of the reverse wedges 146*a* and 146*b* in FIG. 12*a* is about minus 1 degree. This results in a trough or tunnel 168 about $\frac{1}{8}$ inch deep within the pad 134. The combination of the flat surface of the first planing surface 138*b* and the reverse or negative 1 degree surface of the reverse wedges 46*a* and 46*b* permits the boat 10 to carry the weight of additional people while at the same time reducing the fiction of these surfaces as the weight is increased.

The acute angle 166*b* from the horizontal of each of the reverse wedges 146*a* and 146*b* in FIG. 12*b* through FIG. 12*e* are also at about minus 1 degree. The acute angles 170*b* through 170*g* respectively from the horizontal of each of the deadrise surfaces 152*a* and 152*b* in FIG. 12*b* is about 8 degrees; in FIG. 12*c* is about 13 degrees; in FIG. 12*d* is about 14 degrees; in FIG. 12 is about 15 degrees; in FIG. 12*f* is about 20 degrees; and, in FIG. 12*f* is about 21 degrees.

It can therefore be seen that the acute angle from the horizontal of the deadrise surfaces 152*a* and 152*b* increases from the stern 118 towards the bow 116. This increasing angle helps lower the drag of the boat 110 allowing faster planing of the boat 110.

An additional feature of the preferred embodiment is the altering of the pad 134 relative to the boat 110. The rear portion 172 of the pad 135 is tipped upward towards the stern 118 of the boat 110. By tipping the the rear of the pad 134 upward the boat 110 increases its trim angle without requiring the propeller to generate lift. The propeller trim angle can be adjusted to utilize the maximum thrust in moving the boat forward and to eliminate the loss of thrust from the propeller generating lift to the boat 110. The tipping line 174 on the pad 134 is identified in the Figures to be at plane 0—0. At the tipping line 174 the rear of the pad 134 for a distance 176 of about 42 inches is tipped upward at an angle 178 of about $\frac{3}{4}$ degrees. The preferred tipping angle is in the range of $\frac{1}{2}$ to 3 degrees for a length of about 36 inches to 60 inches depending on the weight and the length of the boat 110. The tipping of the rear portion 172 of the pad 134 improves the efficiency of the planing hull 126 and improves the running attitude of the boat 110.

While embodiments and application of the invention or inventions have been shown and described, it would be apparent to those skilled in the art that modifications are possible without departing from the inventive concepts herein. Therefore, the invention is not to be restricted other than by the scope and equivalency of the following claims.

I claim:

1. A boat having a stern and a bow comprising a hull having a generally flat central bottom surface forming a portion of a pad, said surface including a forward portion and a rear portion adjacent said stern, said rear portion tipped upwardly from said forward portion towards said stern, said forward portion blending into said hull with a deadrise surface and said rear portion blending into said hull with a reverse wedge surface, said deadrise surface and said reverse wedge surface forming an intersection at about the position where said rear portion is tipped upwardly from said forward portion.

2. A boat having a stern and a bow comprising a hull having a bottom surface forming a pad, said pad transitioning narrower from said stern to said bow, said pad having a generally flat first portion adjacent said stern and a generally flat second portion connecting said first portion and extending towards said bow, said first portion being tipped at an angle from said second portion, said outer edges of said pad at least adjacent said first portion including reverse wedges and, a deadrise surface at the outer edges of said pad, said deadrise surface forming an intersecting surface with said reverse wedges and continuing forward towards said bow whereby when said boat is on plane and said first portion is a wetted surface said reverse wedges support said first portion to provide stability and prevent the loss of kinetic energy by reducing spray thrown out along the side of said reverse wedges.

* * * * *